US005371491A

United States Patent [19]

Wu

[11] Patent Number: 5,371,491

[45] Date of Patent: Dec. 6, 1994

[54] MULTI-FUNCTIONAL SAFETY APPARATUS FOR USE IN A BATHROOM OR KITCHEN

[76] Inventor: Ting K. Wu, No. 29-2, San Teh St., Shu Lin Chen, Taipei Hsien, Taiwan, Prov. of China

[21] Appl. No.: 137,276

[22] Filed: Oct. 14, 1993

[51] Int. Cl.[5] ..... G08B 19/00

[52] U.S. Cl. ..... 340/632; 340/622; 340/623; 340/641

[58] Field of Search ..... 340/623, 628, 632, 641, 340/693, 622

[56] References Cited

U.S. PATENT DOCUMENTS 3,656,158 4/1972 Goodwater ..... 340/693
4,916,437 4/1990 Gazzaz ..... 340/632
4,922,226 5/1990 Hsieh et al. ..... 340/623 X
5,229,750 7/1993 Welch et al. ..... 340/623 X

*Primary Examiner*—John K. Peng
*Assistant Examiner*—Edward Lefkowitz
*Attorney, Agent, or Firm*—Welsh & Katz, Ltd.

[57] ABSTRACT

A security apparatus is used in a kitchen or a bathroom for detecting the gas leakage and controlling the water temperature and water level in a bathtub or a container. This apparatus is capable of detecting the gas leakage and monitoring the water temperature and level in a container or a bathtub via three relays. The security apparatus further provides an emergency lamp circuit for illumination and a radio circuit for user(s) to listen to a radio program when the users are in a kitchen or a bathroom. The radio program may be replaced with an alarm when a gas leakage occurs, water temperature is too hot or the container or the bathtub is full.

10 Claims, 4 Drawing Sheets

MULTI-FUNCTIONAL SAFETY APPARATUS FOR USE IN A BATHROOM OR KITCHEN

BACKGROUND OF THE INVENTION

The present invention relates to a multi-functional security apparatus for use in a bathroom or kitchen, and particularly to a security apparatus capable of detecting gas leakage, automatically shutting down a gas source, detecting water temperature and water level of a bathtub or a container, controlling the water flow thereby maintaining the water temperature at a preferable temperature. This apparatus is also provided with an alarm circuit for activating alarm signals when gas leakage occurs, water overflows or the water temperature exceeds a predetermined temperature. This apparatus is further provided with an emergency illumination circuit and radio broadcast device.

Today, there are many accidents which happen in kitchens and bathrooms, such as gas leakage and hot water scalding. Though gas leakage detecting apparatuses have been developed, usually they are merely confined to one function, i.e., the detection of gas leakage. As to the control of water temperature in a bathtub or a container, there is no apparatus disclosed which is capable of suitably indicating or controlling the water temperature in the bathtub.

Further, since the water level in the bathtub is manually controlled, i.e., water flow has to be controlled by faucets, this might cause water to overflow-from the bathtub due to a person's inattention.

SUMMARY OF THE INVENTION

An object of the present invention is to provide a multi-functional security apparatus that provides a plurality of functions for user(s).

Another object of the invention is to integrate various functions together in a security apparatus.

Yet another object of the invention is to integrate detecting, controlling and signaling functions within a security system so as to provide new level of comfort, convenience and safety for a user.

According to the present invention, a multi-functional security apparatus includes a gas detecting circuit for automatically shutting down a gas source when a gas leakage is detected, a water temperature detecting circuit for maintaining the water temperature at a desired temperature, and a water level detecting circuit for maintaining the water level at a preferred level. This security apparatus is provided with respective control valves thereby effectively controlling the gas flow, water flow, and the mixture of the hot water and cold water.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
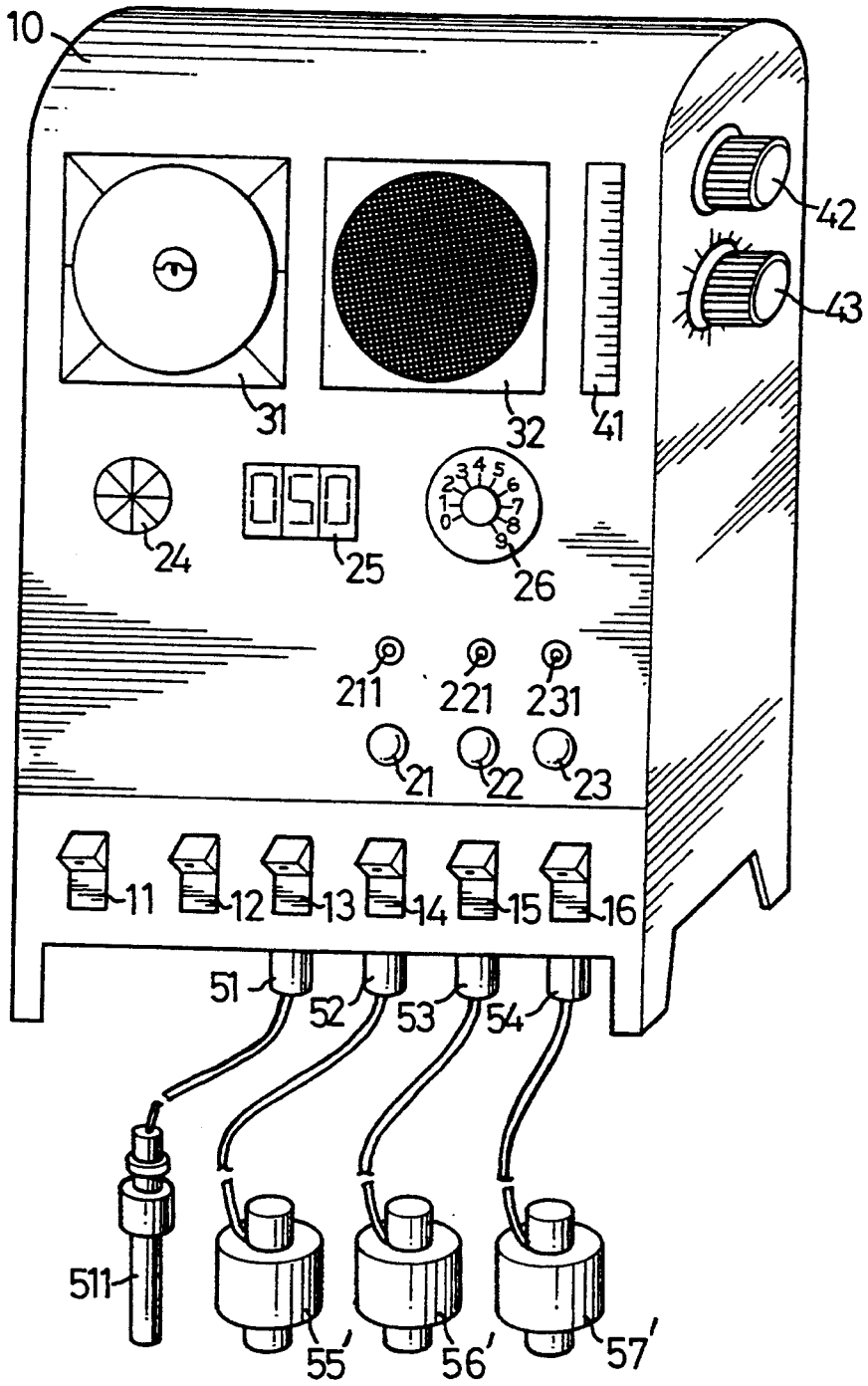
FIG. 1 is a perspective view of a multi-functional security apparatus according to the present invention.

Referring to FIG. 1, there is shown a perspective view of a security apparatus in accordance with the present invention. As shown, the apparatus is housed by a case 10, which has its front panel provided with a lamp 31 for emergency illumination, a speaker 32 for outputting music or alarm signals, a tuning scale 41 for showing the radio channel selected by a user, a gas leakage sensor 24 for detecting gas leakage or CO (carbon monoxide) leakage, an indicating display 25 for indicating water temperature, and a temperature setting knob 26 for setting a preferred temperature. The front panel of the case 10 is also provided with a gas leakage testing button 21, a water temperature testing button 22, and a water level testing button 23 for activating the respective testings. Each of the buttons is further provided with an indicating lamp, i.e., lamps 211, 221, and 231 for indicating the corresponding operation is occurring. The front panel of the case 10 is further provided with six switches, which are power switch 11, emergency illumination switch 12, radio switch 13, gas detection switch 14, water temperature detecting switch 15, and water level detecting switch 16. The case 10 is further provided with a volume control 42 and a channel selector 43 in a wall thereof for the user to select a desired channel of the radio program and a preferable volume of the music or alarm. The case 10 is provided with four jacks (not shown) under its bottom and each jack is provided with a corresponding plug, i.e., a temperature/level plug 51, a gas control plug 52, a hot water control plug 53, and a cold water control plug 54, each of which is connected to a corresponding element, i.e., a water temperature/level sensor 511, a gas control valve 55', a hot water control valve 56' and a cold water control valve 57', via a respective electricity cable.

Figure 2:
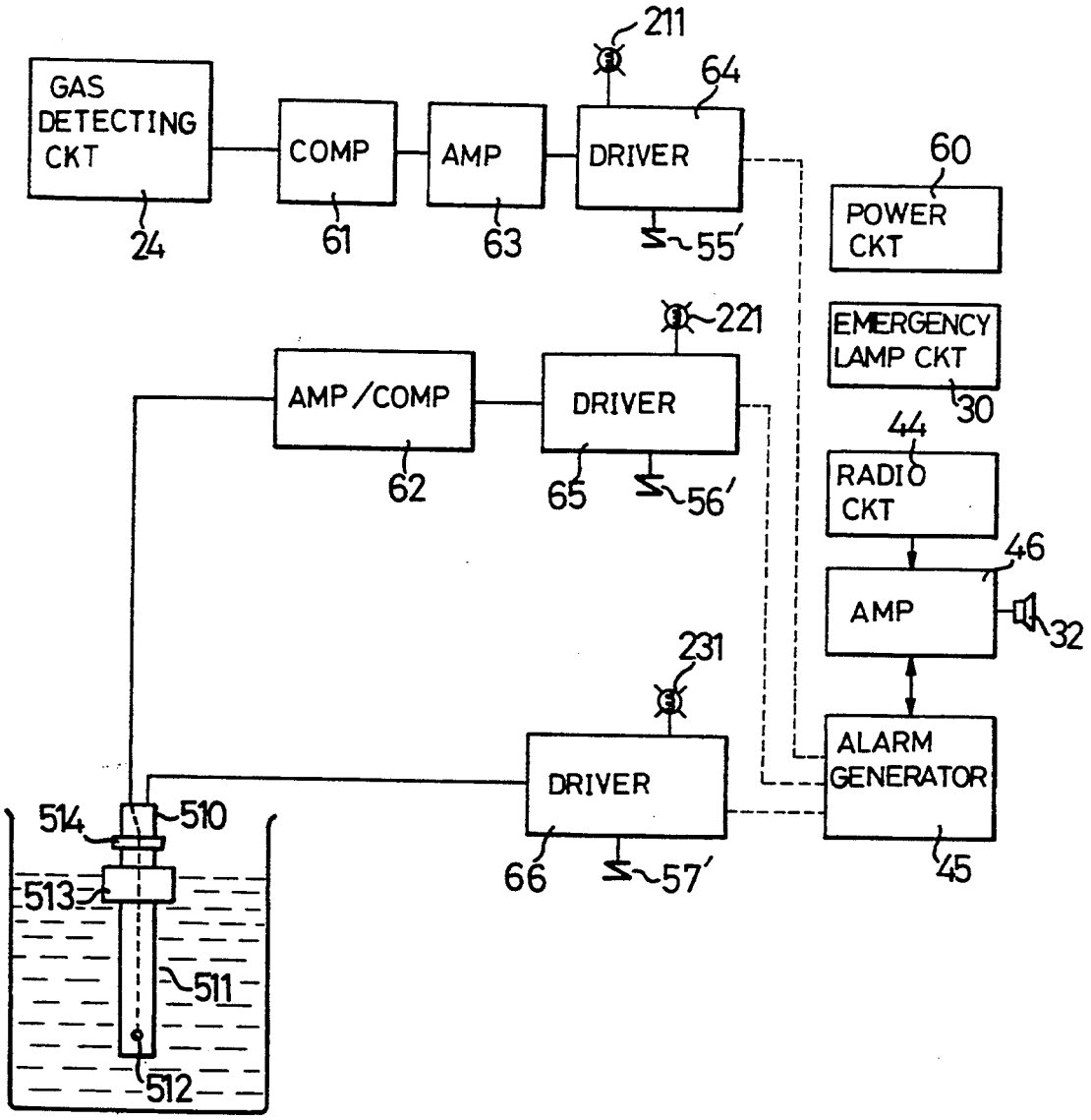
FIG. 2 is a control circuit of the security apparatus of FIG. 1 illustrated in a block diagram.

FIG. 2 is a control logic block diagram showing the interconnection of various functional circuits. A gas detecting circuit 24 for detecting gas leakage is connected to a comparator 61, which is further connected to an amplifier 63. The amplifier 63 is connected to a driver 64 for driving a gas control valve 55' to shut down the gas flow. Meanwhile, the driver 64 also enables an alarm generator 45 to send an alarm signal to a speaker 32 via an amplifier 46 and turns on an indicating lamp 211 simultaneously for warning of the gas leakage. A water temperature/level sensing unit 511 is provided and fixed to the wall of a bathtub or a container for detecting the water temperature and water level thereof. The water temperature/level sensing unit 511 having a tube 510 and a temperature sensor 512 placed within the tube 510 as to detect the temperature of the water. The temperature of the water is detected by the sensor 512 being in contact with the water as the sensor 512 is submerged. The water temperature sensor 512 generates a signal corresponding to the water temperature and the signal is further amplified and compared with a preset signal within an amplifier/comparator 62. The preset signal corresponding to a preferred temperature is set by a temperature knob 26 as shown in FIG. 1. When the detected signal is higher than the preset signal, the amplifier/comparator 62 will send a signal to a driver 65, which enables a hot water control valve 56' to stop the hot water flow and turns on an indicating lamp 221 for indicating that a water temperature exceeds the preferred temperature. Similarly, the driver 65 will enable the alarm generator 45 to send an alarm signal to the speaker 32 via an amplifier 46. The tube 510 is further encircled with a magnetic float 513 which has a permanent magnet therein (not shown) and moves upward and downward in response to the change in water level. The tube 510 is further encircled with a stopper 514 above the magnetic float 513. The stopper 514 is provided with a reed switch therein (not shown). When the magnetic float 513 floats up and is in contact with the stopper 514, the reed switch within the stopper 514 is induced by the permanent magnet within the magnetic float. Thus, the reed switch will be on. The reed switch is further connected to a driver 66 for stopping cold water flow, as the water reaches the preferred water level. Similarly, the driver 66 will enable the alarm generator 45 to send an alarm signal to the speaker 32 via the amplifier 46 as to sound an alarm informing a preferred water level has been reached. The security apparatus is further provided with a radio circuit 44 for receiving AM, FM and Citizens Band (CB) radio. The radio circuit 44 outputs signals to the speaker 32 via an amplifier 46. In addition to having a radio function, the security apparatus includes an emergency illumination function. An emergency lamp circuit 30 is provided for illumination when a power supply is interrupted. All of the power required by the security apparatus is provided by a power circuit 60, for the sake of the clarity, the interconnection thereof is not shown.

Figure 3:
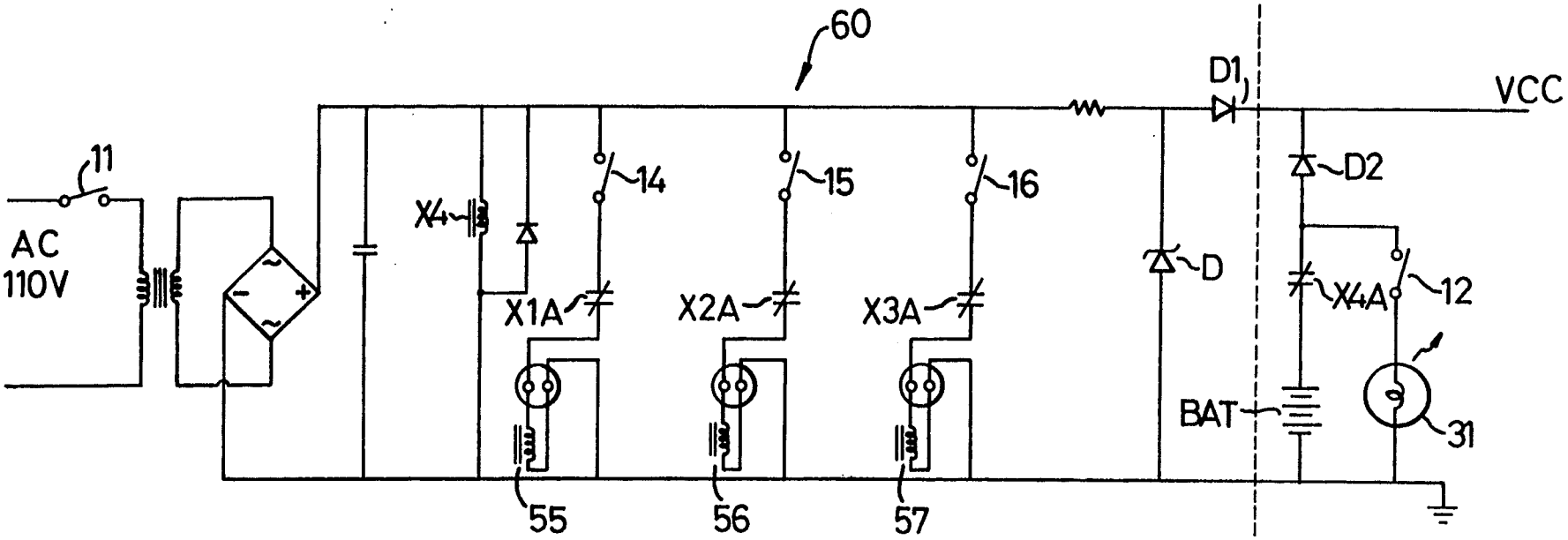
FIG. 3 is a circuit diagram showing the power arrangement of the security apparatus of FIG. 1.

Referring to FIG. 3, a circuit diagram of the power arrangement in accordance with this invention is shown. The power circuit comprises a power switch 11 for controlling the on/off of the security apparatus, a transformer for transforming the input voltage into a suitable level for use in a later stage, a Zener diode D and a bridge rectifier for providing the DC power requisite for the whole control circuit. The rectifier has an output connected to a coil of a relay coil X4, which is further parallelly connected to a first switching means, a second switching means, and a third switching means. The first switching means includes a switch 14, a normally closed contact X1A and a coil 55 connected in series for controlling a gas control valve 55' shown in FIG. 1. The second switching means includes a switch 15, a normally closed contact X2A and a coil 56 connected in series for controlling a hot water control valve 56' shown in FIG. 1. The third switching means includes a switch 16, a normally closed contact X3A and a coil 57 connected in series for controlling a cold water control valve 57' shown in FIG. 1. The output of the rectifier is further connected to a normally closed contact X4A and a battery BAT via two oppositely connected diodes, D1 and D2. The connecting point of the diodes D1 and D2 has a voltage level VCC, which is used to provide the DC power requisite for the whole security apparatus. The normally closed contact X4A and the battery BAT are parallelly connected to a switch 12 and an emergency lamp 31. As the user presses on the switch 11, the coil X4 is excited, the normally closed contact X4A will be opened. When the power supply is suddenly interrupted, the normally closed contact X4A will remain closed, the user may switch on the switch 12 for turning on the emergency lamp 31.

Figure 4:
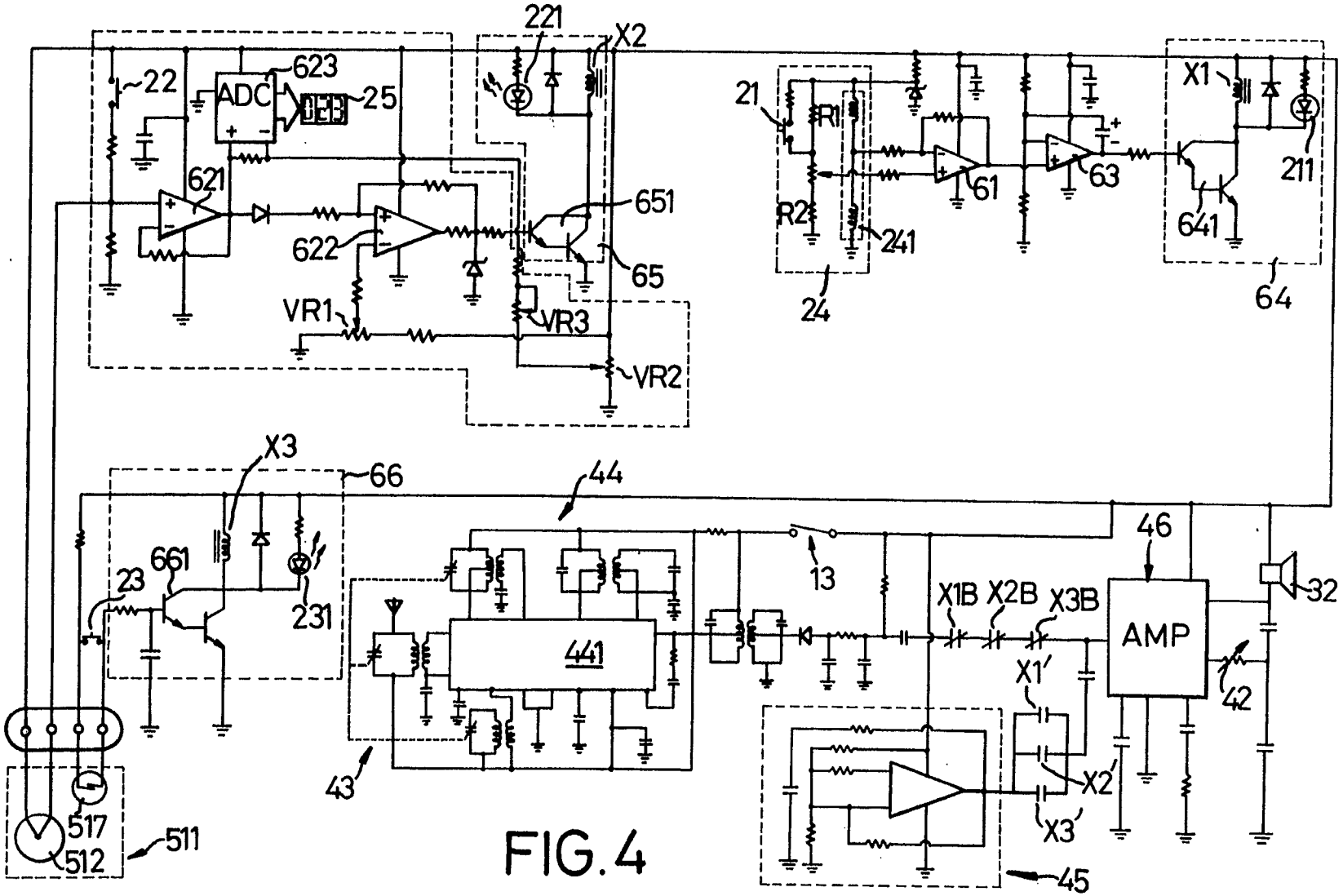
FIG. 4 is a circuit diagram showing interconnection of various functional circuits of the security apparatus of FIG. 1.

Referring to FIG. 4, a control circuit of the security apparatus in accordance with this invention is shown. The control circuit has an alarm generator 45 (shown in dash lines) for generating an alarm signal. The alarm generator 45 is connected to an amplifier 46 via three normally open contacts X1', X2' and X3', which are connected in parallel. The amplifier 46 has an output to connect to a speaker 32 and a variable resistor 42 is provided for controlling the volume of the speaker. It can be seen that a switch 13 is provided for controlling a radio circuit 44, which is consisted of a radio integrated circuit 441 and a plurality of respective peripheral components. As shown, a channel selector 43 is provided for selecting a desired program and three serially connected normally closed contacts X1B, X2B, and X3B are provided for connecting to the amplifier 46. The control circuit also includes a gas detecting circuit 24 which is composed of a bridge having a gas sensor 241, which is composed of two serially connected coils as two arms of the bridge, and two resistors R1, R2 as the other two arms of the bridge. The output contact of the arm with two resistors is further connected to a non-inverted input of a comparator 61 via a variable resistor for setting a predetermined voltage in the gas detecting circuit 24. When the gas detecting circuit 24 senses a gas leakage, the voltage on the inverted input of the comparator 61 is reduced. Thus, when the voltage is lower than a voltage preset by the variable resistor, the comparator 61 will send a signal to an amplifier 63. Then, the amplifier 63 will send a signal to a driver 64 comprising a Darlington amplifier 641, a relay X1, and an indicating lamp 211. Thus, the Darlington amplifier 641 will be triggered and the relay X1 and the lamp 211 are activated. Therefore, the normally closed contact X1A in FIG. 3 will be opened and the gas flow will be stopped, meanwhile, the states of the normally closed contact X1A and the normally open contact X1' will be alternated. Thus, the alarm signal generated by the alarm generator 45 will be sent to the amplifier 46 and the radio circuit 44 will be disconnected from the amplifier 46. An alarm is thus generated for warning occupants of the house of the gas leakage. A switch 21 and a resistor are further provided in parallel connection to the resistor R1 of the bridge for testing whether the above-mentioned function is correctly operated. When the switch 21 is on, the resistance of the arm with the switch 21 is reduced, then the voltage in the non-inverted input of the amplifier is increased. Therefore, the coil X1 is again excited so that the gas flow is stopped, an alarm signal is generated and the indicating lamp 211 is illuminated.

The control circuit is further provided with a water temperature/level sensing unit 511, which consists of a temperature sensor 512 and a reed switch 517 for detecting the temperature and the level of the water in the bathtub. When the temperature sensor 512 detects an increase in water temperature, the resistance of the temperature sensor 512 is reduced. The temperature sensor 512 will output a signal to an amplifier/comparator 62 which is composed of an amplifier 621 and a comparator 622. The signal is sent to the non-inverted input of the amplifier 621 and amplified therein then further sent to a non-inverted input of the comparator 622 to compare with a preset voltage on an inverted input of the comparator 622. The preset voltage is controlled by a variable resistor VR1, corresponding to the knob 26 shown in FIG. 1 for a user to preset a preferable temperature. When the amplified signal is greater than the preset voltage, the comparator will output a signal to a driver 65, which comprises a Darlington amplifier 651, an indicating lamp 221 and a relay coil X2. Thus, the indicating lamp 221 is illuminated and the relay coil X2 is excited. Therefore, the normally closed contact X2 in FIG. 3 will be opened, the hot water flow will be stopped. The state of the normally closed contact X2 in the radio circuit 44 and the normally open contact X2 in the alarm generator 45 will be alternated. A switch 22 and a resistor are further provided parallelly to the temperature sensor 512 for testing whether the corresponding functions may be correctly operated When the switch 22 is "on" the voltage on the non-inverted input of the amplifier 621 increases. Thus, the lamp 221 is illuminated and the relay coil X2 is excited. Then, the radio circuit 44 is disconnected and the alarm generator 45 is in conducting state. The amplified signal is further sent to an analog-to-digital converter 623, which comprises a plurality of output lines connected to a display unit 25 for showing the current temperature of the water. When the displayed temperature is lower than the preferable temperature set by the user, the user may increase the hot water flow. A variable resistor VR2 and a variable resistor VR3 are respectively provided to cooperate with the analog-to-digital converter 623 for calibrating the display unit 25 to conform with the current water temperature.

The reed switch 517 of the temperature/level sensing unit 511 is directly connected to a driver 66 having a Darlington amplifier 661 for turning on an indicating lamp 231 and exciting a relay coil X3 when the reed switch 517 is in connection state i.e., the magnetic float 513 is in contact with the stopper 514 in FIG. 2. Similarly, the normally closed contact X3 in FIG. 3 will be opened, and the cold water flow will be stopped. Meanwhile the state of the normally closed contact X3 in the radio circuit 44 and the normally open contact X3 in the alarm generator 45 will be alternated. A switch 23 is further provided in parallel connection with the reed switch 517 for testing whether the corresponding functions may be correctly generated. When the switch 23 is "on", the lamp 231 will be illuminated and the relay X3 will be excited. Then, the cold water control valve 57 will be excited, and the cold water flow will be stopped.

Although the invention has been explained in relation to its preferred embodiment, it is to be understood that many other possible modifications and variations can be made without departing from the spirit and scope of the invention as hereinafter claimed.

What is claimed is:

1. A security apparatus contained within a single housing for controlling water temperature and water level of a bathtub and detecting a gas leakage comprising:

a first relay, a second relay and a third relay, each having a coil, a first normally closed contact, a second normally closed contact and a normally open contact;

a gas detector circuit being connected to the coil of the first relay for detecting a gas leakage;

a water temperature control circuit being connected the coil of the second relay and having a temperature sensor for detecting a water temperature and a switch for selecting a preferable water temperature, said water temperature control circuit activating the second relay when the detected water temperature is higher than the selected water temperature;

a water level control circuit being connected to the coil of the third relay for activating the third relay when the water level reaches a desirable level;

a gas control valve being serially connected to the first normally closed contacts of the first relay for controlling a gas flow flowing therethrough;

a hot water control valve being serially connected to the first normally closed contact of the second relay for controlling a hot water flow flowing therethrough;

a cold water control valve being serially connected to the first normally closed contact of the third relay for controlling a cold water flow flowing therethrough.

2. A security apparatus as claimed in claim 1 further comprising:

an alarm generator connected to the normally open contacts, which are parallelly connected for sending an alarm signal when any of the normally open contacts closes;

a speaker means connected to the normally open contacts for outputting the alarm signal.

3. A security apparatus as claim in claim 1 further comprising:

a radio circuit serially connected to the second normally closed contacts for receiving a radio program;

a speaker means connected to the second normally closed contacts for outputting the radio program.

4. A security apparatus as claim in claim 2 further comprising:

a radio circuit connected to the speaker means via the second normally closed contacts, which are serially connected to the second normally closed contacts for the speaker means to output a radio program.

5. A security apparatus as claimed in claim 1 further comprising:

a fourth relay having a normally closed contact connected to a battery;

an emergency lamp being parallelly connected to the normally closed contact and the battery for illumination when the fourth relay is disabled.

6. A security apparatus according to claim 1 wherein said water temperature control circuit comprises a display unit for displaying a detected water temperature.

7. A security apparatus according to claim 1 wherein said water level control circuit comprises a tube and a magnetic float encircling the tube and moving upward and downward in response to a change in water level and a stopper being provided above the magnetic float, a magnet and a reed switch being respectively provided within the magnetic float and the stopper for triggering the water level control circuit.

8. A security apparatus according to claim 7 wherein said temperature sensor is placed within the tube.

9. A security apparatus according to claim 7 wherein said tube is secured on an inner wall of the bathtub.

10. A security apparatus according to claim 7 wherein said stopper is secured on an inner wall of the bathtub.

* * * * *